US006810801B2

(12) United States Patent
Mürdter

(10) Patent No.: US 6,810,801 B2
(45) Date of Patent: Nov. 2, 2004

(54) METHOD AND DEVICE FOR PRINTING ON THE SURFACE OF A STRIP-SHAPED MEDIUM

(75) Inventor: Herbert Mürdter, Albstadt (DE)

(73) Assignee: Mettler-Toledo (Albstadt) GmbH, Albstadt (DE)

( * ) Notice: Subject to any disclaimer, the term of this patent is extended or adjusted under 35 U.S.C. 154(b) by 0 days.

(21) Appl. No.: 10/363,801

(22) PCT Filed: Mar. 7, 2002

(86) PCT No.: PCT/EP02/02519

§ 371 (c)(1),
(2), (4) Date: Mar. 6, 2003

(87) PCT Pub. No.: WO02/070268

PCT Pub. Date: Sep. 12, 2002

(65) Prior Publication Data

US 2004/0101343 A1 May 27, 2004

(30) Foreign Application Priority Data

Mar. 8, 2001 (DE) ..... 101 11 228

(51) Int. Cl.[7] ..... B41F 1/08
(52) U.S. Cl. ..... 101/288; 400/615.2
(58) Field of Search ..... 101/92, 228, 288; 400/88, 613, 615.2; 156/564, 566, 567

(56) References Cited

U.S. PATENT DOCUMENTS 4,295,915 A 10/1981 Sakaguchi et al.
5,497,701 A * 3/1996 Uland ..... 101/288
5,940,107 A 8/1999 Fox
6,067,103 A * 5/2000 Ewert et al. ..... 347/171
6,585,437 B1 * 7/2003 Wiklof et al. ..... 400/621

FOREIGN PATENT DOCUMENTS

| | | |
|---|---|---|
| DE | 2621273 | 11/1976 |
| DE | 3811221 | 10/1989 |
| DE | 3935348 | 5/1991 |
| DE | 4132369 | 4/1993 |
| EP | 0758955 | 4/1996 |
| GB | 174028 | 5/1922 |

* cited by examiner

*Primary Examiner*—Ren Yan
(74) *Attorney, Agent, or Firm*—Friedrich Kueffner

(57) ABSTRACT

A problem associated with label printers for liner-free labels is that the self-adhesive coated surface (4) of the label strip to be printed is exposed as it passes through the printer and is guided over a roller (10) that transports the label strip through the printer. Said strip must be released from the roller to be issued at the exit (15) of the printer. According to the invention, instead of the provision of conventional scraper elements downstream of the roller (10), the label strip is embossed, which counteracts the tendency of the label strip to become wound around the roller (10), thus enabling the label strip to be detached from the roller (10) in a reliable manner.

22 Claims, 2 Drawing Sheets

(b)

(a)

METHOD AND DEVICE FOR PRINTING ON THE SURFACE OF A STRIP-SHAPED MEDIUM

BACKGROUND OF THE INVENTION

1. Field of the Invention

The invention pertains to a method and a device for printing on one surface of a strip-shaped medium, the other surface of which carries a self-adhesive coating, the strip being transported in its longitudinal direction through a printing mechanism, in which the surface of the medium to printed is guided past a print head while the surface with the self-adhesive coating is guided over a driven roller, and to a device suitable for implementing the method.

2. Description of the Related Art

Methods and devices of the type in question are used especially for producing the printed labels which are affixed to items of merchandise in retail sales establishments. In particular, weight information such as the that originating from a self-service scale, price information, and/or barcodes, i.e., information which is important for the handling of sales transactions, is printed on the surface to be printed. The circumstance that the surface with the self-adhesive coating is freely exposed as it is being guided through the printing operation offers an advantage over the conventional method, in which the surface with the self-adhesive coating is provided with a liner strip, from which the printed labels must be peeled off before they can be applied, the advantage being that the medium supplied to the printing operation, usually in the form of a roll, takes up less space, and at the same time, the costs associated with the liner strip are also eliminated. The handling of the medium with the exposed self-adhesive surface, however, requires special measures during the printing operation to prevent the medium from getting permanently stuck during the printing operation.

In known methods and devices of the type indicated above (EP 0 758 979 B1 and EP 0 758 955 B1), this problem is dealt with in that the roller and also the other surfaces which come in contact with the self-adhesive coating during the printing operation are provided with an adhesive-repellent coating. This is not sufficient, however, to ensure that the medium can be separated reliably from the roller. For this reason, a release blade or a small-diameter release roller is installed as an especially important element downstream in the transport direction from the roller and immediately adjacent to it, the surface of the release blade or roller being provided with an adhesive-repellent coating. The strip-shaped medium is thus directed away from the roller as it passes over this release element.

SUMMARY OF THE INVENTION

The invention is based on the task of providing a method and a device of the type indicated above which are characterized by unusual simplicity and reliability.

With respect to the method, this task is accomplished by impressing into the medium a shape behavior which allows the medium to separate itself from the roller.

The strip-shaped medium, which is usually a paper suitable for thermal printing, has the tendency to follow the roller with which its self-adhesive surface is in contact for the purpose of being transported; that is, the medium tends to wrap itself around the roller unless measures are taken downstream from the roller in the transport direction to separate the medium from the roller. In the solution according to the invention, no measures of this type are needed. Instead, the shape behavior impressed into the medium ensures that it will separate itself from the roller as soon as it is no longer being guided to keep it in contact with the roller. In most cases it is the print head which provides this guidance; the print head is usually located at a tangent to and opposite the roller and exerts pressure on the surface of the medium to be printed, thus pressing it toward the roller. After the medium has been transported between the print head and the roller, this guidance is no longer present, as a result of which the medium can unfold the shape behavior impressed into it, which allows it to assume a shape which deflects it away from the roller.

A first basic embodiment consists in that a curvature in the longitudinal direction is impressed into the medium during transport upstream of the roller, the center of this curvature being opposite the surface to be printed.

This embodiment takes advantage of the intrinsic stiffness of the strip-shaped medium, which causes the medium to try to retain the curvature impressed into it. Even if, after the curvature has been impressed, the medium is stretched out straight again as it is being transported to the roller, it assumes this curvature again after it has passed beyond the roller. This means that it curves away from the roller and thus separates from it reliably.

An effective elaboration of this basic embodiment consists in that the surface of the medium to be printed is transported over an impressing cylinder with a radius suitable for the purpose around a wrap angle suitable for the impressing. While the medium is passing around the impressing cylinder, the desired curvature is impressed continuously. The desired degree of curvature can be adjusted by selecting the wrap angle and the radius of the impressing cylinder.

A second basic embodiment of the invention consists in that a rib extending in the longitudinal direction is impressed into the medium before it leaves the driven roller.

This rib increases the longitudinal stiffness of the strip-shaped medium and increases its tendency to stretch itself out straight. As the strip-shaped medium passes over the roller, it therefore separates approximately at a tangent from the roller, which means that the medium is prevented from wrapping itself around the roller.

It is advisable for this basic embodiment to be implemented in such a way that a rib is impressed into the medium along each of the two edges parallel to the longitudinal direction. The ribs impressed into the edges of the medium provide a significant increase in the tendency of the medium to straighten itself out, but they also leave the entire space between the edges free for printing. The profiling of the medium caused by the ribs therefore does not interfere with the printing in the free area.

In this version of the method according to the invention, the situation can be allowed in which a curvature has already been impressed into the medium in its longitudinal direction before it passes through the printing mechanism, the center of this curvature being opposite the surface with the self-adhesive coating. This curvature is usually the result of supplying the strip-shaped medium from a roll, in which it is wound up in such a way that the surface with the self-adhesive coating faces the center of the roll. As it reaches the roller, the strip-shaped medium is therefore already curved in such a way that it tends to wrap itself around the roller. As a result of the ribs impressed into the medium, however, the strip straightens out precisely in opposition to this curvature and therefore separates itself reliably from the roller.

The basic principle of a device according to the invention suitable for implementing the method according to the invention is stated in claim 7. Embodiments of the invention suitable for implementing the variants of the method discussed under the first basic embodiment are indicated in claims 8–15, and devices suitable for implementing the variants of the method discussed under the second basic embodiment are specified in claims 16–19. The device features of claims 20–22 can be applied effectively in all cases.

BRIEF DESCRIPTION OF THE DRAWINGS

Additional features, details, and advantages of the invention can be derived from the following description and from the drawing, in which the invention is explained and illustrated on the basis of exemplary embodiments.

DETAILED DESCRIPTION OF THE PREFERRED EMBODIMENTS

Figure 1:
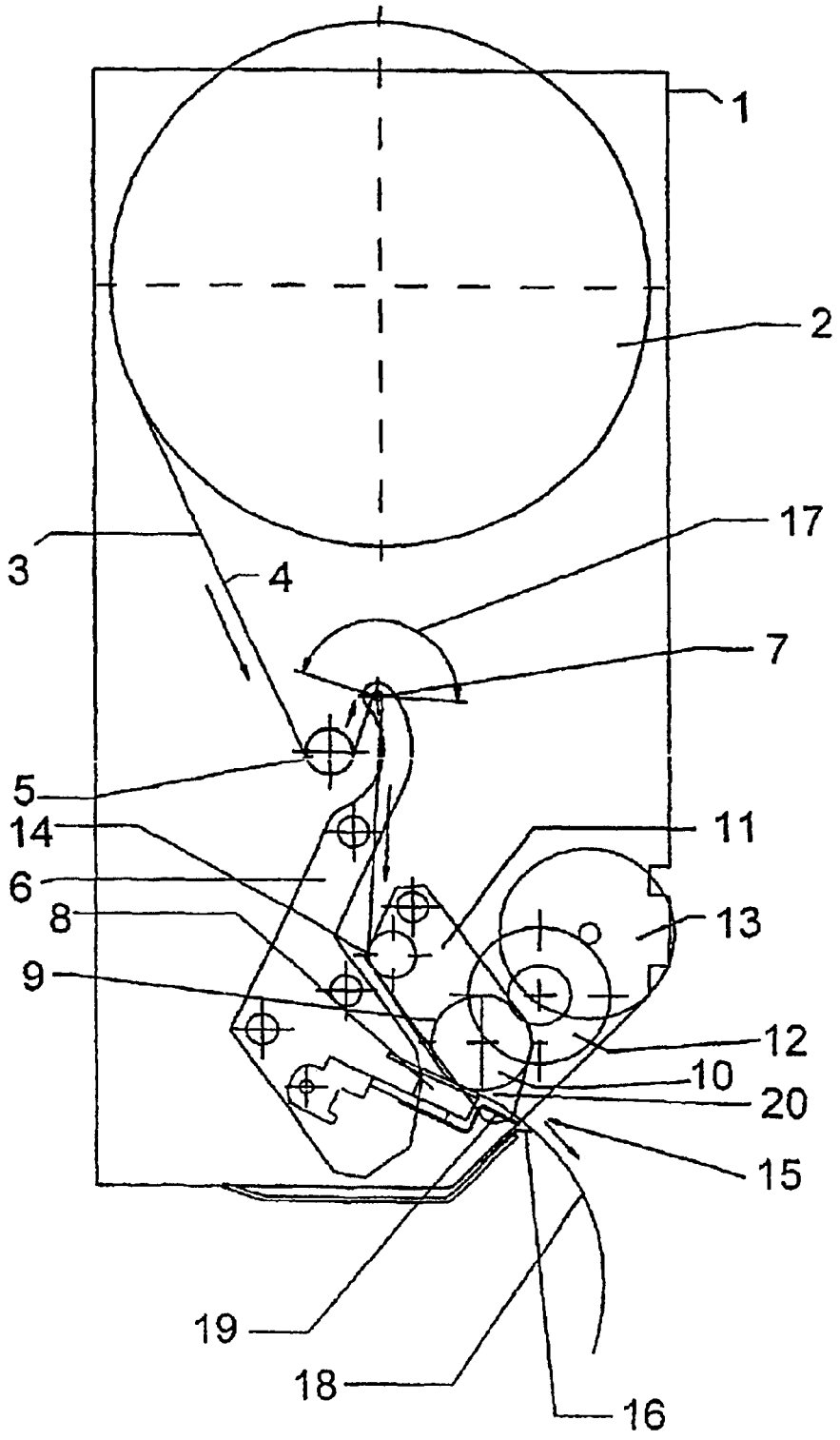
FIG. 1 shows a schematic diagram of a first embodiment of a device for printing.

The embodiment shown in FIG. 1 has a base plate 1, on which all the components of the device are mounted. A strip-shaped medium to be printed is wound up to form a supply roll 2, which is supported on the base plate 1 so that it is free to rotate. The medium consists of, for example, thermal printing paper, which has a surface 4 with a self-adhesive coating and an opposite surface 3, which is the surface to be printed. According to the state of the art, media of this type are known as "linerless label material" or "linerless label web". The supply roll 2 is wound so that the surface 4 with the self-adhesive coating faces the center of the supply roll 2.

A certain distance away from the supply roll 2 and coaxial to it, a deflection roller 5 is supported on the base plate 1 with the freedom to rotate. Coaxial to the deflection roller 5 and set back with respect to it in the direction toward the supply roll 2 is an impressing cylinder 7, which is supported either fixedly or with freedom to rotate on a bracket 6, which is connected to the base plate 1. A bar-shaped thermal print head, which lies in plane perpendicular to the base plate 1 and therefore parallel to the axes of the deflection roller 5 and the impressing cylinder 7, is mounted on the end of the bracket 6 facing away from the impressing cylinder 7.

The print head 8 extends at a tangent to the lateral surface 9 of a roller 10, which is supported with freedom of rotation opposite the print head 8 on a bearing plate 11 connected to the base plate 1. The roller 10 is driven by way of schematically indicated gearing 12 and an electric motor 13, also indicated merely in schematic fashion, which is mounted on the base plate 1. In addition, a deflection roller 14 is rotatably supported on the bearing plate 11 at a point situated between the roller 10 and the impressing cylinder 7.

The strip-shaped medium supplied from the supply roll 2 travels from the supply roll 2 to the deflection roller 5, across which the surface 4 with the self-adhesive coating passes, and then proceeds to the impressing cylinder 7, across which the surface 3 to be printed passes. From the impressing cylinder 7, the medium travels to the deflection roller 14, across which the surface 4 with the self-adhesive coating passes, and then proceeds to the roller 10, against which the self-adhesive surface 4 is pressed by the print head 8, which is in contact with the surface 3 to be printed. As a result of this engagement, the rotational movement introduced by the electric motor 13 and the gearing 12 to the roller 10 is transmitted to the medium, as a result of which it is pulled from the supply roll 2 and transported in its longitudinal direction. The transport movement and the actuation of the thermal print head 8 are coordinated with each other by an electronic control unit (not shown) in a manner known in and of itself in such a way that the print head 8 prints the desired material onto the surface 3 of the medium to be printed as it passes between the print head 8 and the roller 10. In particular, labels serving to identify merchandise are printed, which are torn off from the strip-shaped medium after it has passed through the device. To assist the tearing-off, a tear-off bar 16 facing the surface 13 to be printed is provided at the exit 15 of the device. This bar extends across the width of the strip-shape medium, so that the printed labels can be torn off.

The relative position of the two deflection rollers 5, 14 with respect to the impressing cylinder 7 determine the wrap angle 17 by which the medium passes around the impressing cylinder 7. The radius of the impressing cylinder 7 is relatively small, as a result of which the surface 3 of the medium to be printed is stretched in comparison to its surface 4 with the self-adhesive coating. As a result, a permanent curvature is impressed into the medium in its longitudinal direction, the center of which curvature is opposite the surface 3 to be printed. Although, as it is being transported between the impressing cylinder 7 and the deflection roller 14 and between the deflection roller 14 and the roller 10, the medium is straightened out again, in opposition to its curvature, by the tension exerted by the roller 10 in the longitudinal direction of the medium, that is, in its transport direction, the medium assumes the impressed curvature again, as shown at 18, after it has passed between the roller 10 and the thermal print head 8 and thus been released from the transport tension. As a result, the medium separates reliably from the roller 10, because the force with which the impressed curvature is accepted is sufficient to overcome the adhesive force between the lateral surface 9 of the roller 10 and the self-adhesive surface 4 of the medium.

In contrast to the arrangement according to FIG. 1 in which the deflection roller 5 and the impressing cylinder 7 are a certain distance apart, it is also possible for the deflection roller 5, when in its operating position, to form a clamping gap with the impressing cylinder 7, through which gap the medium passes. In this case, an axial lateral surface line of the deflection roller 5 is opposite an axial lateral surface line of the impressing cylinder 7, one on each side of the medium. These lines thus determine the point at which the wrap angle 17 begins. So that the medium can be inserted easily when the roll 2 is replaced, an adjusting device (not shown) can be provided, by means of which the deflection roller and the impressing cylinder can be moved into a release position with respect to each other. After they have thus been moved a certain distance apart, the strip-shaped medium can be easily inserted between them.

In this design, therefore, the opposing lateral surface lines of the impressing cylinder 7 and of the deflection roller located upstream in the transport direction define the point at which the wrap angle begins. In addition or as an alternative, a deflection roller of this type could also be located downstream of the impressing cylinder 7 (not shown) to define the end of the wrap angle 17 in the same way.

Directly behind the print head 8 and the roller 10 in the transport direction, a guide element 19 is located opposite the surface 3 to be printed, this element being mounted on the bracket 6. The guide element 19 extends as far as the exit point of the device and limits the peel-off angle 20 caused by the impressed curvature, i.e., the angle which the medium assumes with respect to the lateral surface 9 of the roller 10 as a result of the impressed curvature. In this way, the medium is still conducted reliably out of the device even after part of it has been torn off against the tear-off bar 16.

The jackets of the deflection rollers 5 and 14 and of the roller 10, over which the self-adhesive surface 4 of the medium passes, are designed to repel adhesion by the use of suitable coatings, for example, The arrangement of the medium-transporting roller 10 opposite the print head 8 corresponds to the known state of the art in the field of label printers. For this reason, the roller 10 is frequently referred as the "printing roller". It is also conceivable, however, for the medium-transporting roller 10 to be located downstream from the print head 8 in the transport direction and for a non-driven opposing element to be provided for the print head 8, which element holds the medium against the print head 8 for the printing operation.

If the medium has not acquired sufficient curvature by having been wrapped around the impressing cylinder 7, it is possible to provide a cascade of several impressing cylinders 7, over which the medium passes in succession during transport.

Figure 2:
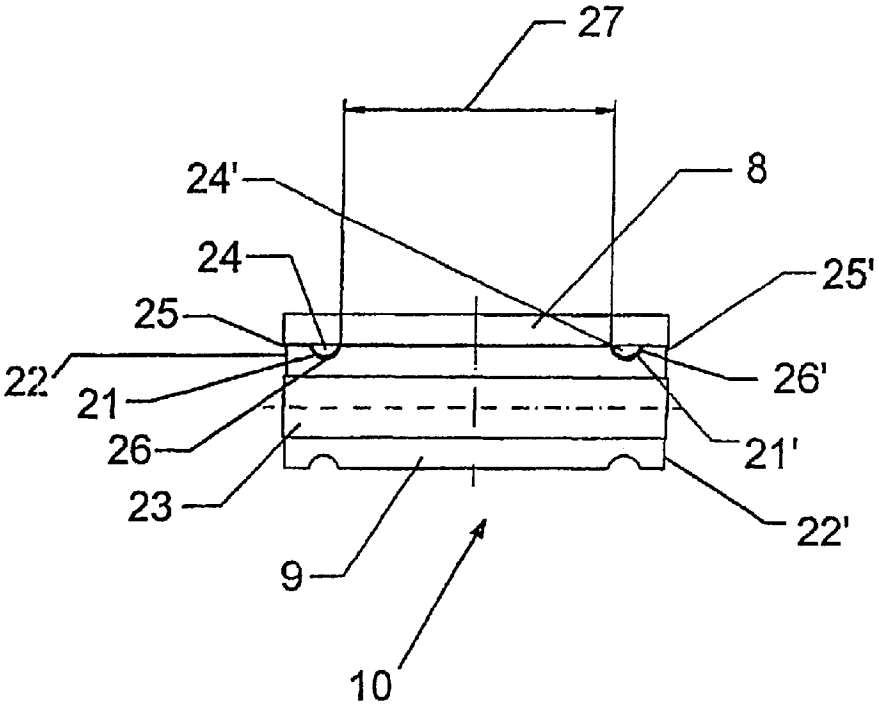
FIGS. 2(*a*) and 2(*b*) show views of the arrangement of a roller and a print head for a second embodiment of a device for printing.
Figure 2:
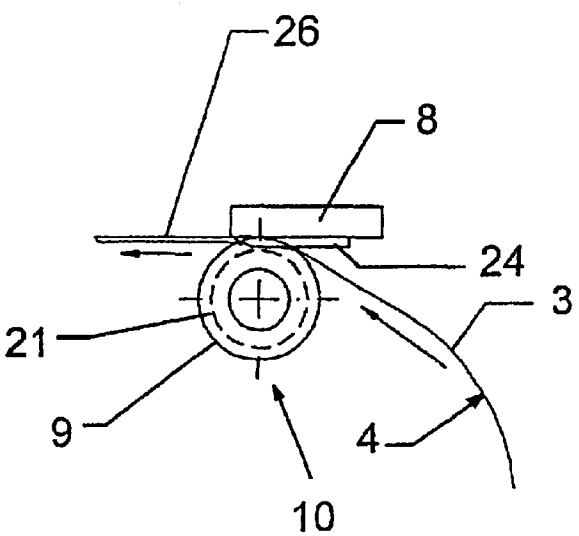

Another embodiment, only parts of which are shown in FIG. 2, is the same as the embodiment shown in FIG. 1 with respect to the arrangement of the supply roll 2 on the base plate 1, the opposite positioning of the thermal print head 8 and the roller 10, and the drive by the electric motor 13 via the gearing 12. In contrast to the embodiment shown in FIG. 1, however, no measures for impressing curvature are provided in the embodiment according to FIG. 2 along the transport route between the supply roll 2 and the roller 10, and no element corresponding to the impressing cylinder 7 is provided.

The medium being pulled from the supply roll 2, however, already has a certain pre-curvature as a result of being rolled up in this way. The center of this curvature is opposite the surface 4 with the self-adhesive coating. This pre-curvature is indicated symbolically in FIG. 2(*a*), which shows a schematic axial view of the roller 10 and the print head 8, even though in reality the medium is stretched out straight in the transport direction upstream of the roller 10 by the tension exerted by the roller 10.

It can be seen in FIG. 2(*a*) and especially in the axial cross section according to FIG. 2(*b*) through the roller that two circumferential grooves 21, 21', which are open radially toward the outside and have a semicircular cross section, are formed in the jacket 9. These grooves 21, 21' are close to the two axial ends 22, 22' of the jacket 9, which is mounted on the core 23 of the roller. On the bar-shaped print head, which extends at a tangent to the jacket 9, two projections 24, 24' are provided, which engage in the grooves 21, 21' and have a cross-sectional form complementary to the cross section of the grooves. As the medium is being transported between the roller 10 and the print head 8, therefore, the projections 24, 24' act on the surface 3 to be printed in such a way as to impress ribs 26, 26' extending in the longitudinal direction, into it, the lateral edges 25, 25' of the medium being approximately flush with the axial ends 22, 22' of the jacket. These ribs 26, 26' cause the medium to straighten out downstream of the print head 8 and the roller 10 in the transport direction. As a result, the medium will separate reliably from the roller 10 in opposition to the original tendency to wrap itself around the roller 10 as a result of its pre-curvature.

The medium which has been stretched out straight then arrives at the exit from the device, where an element corresponding to the tear-off bar 16 of FIG. 1 is provided, so that the individual labels can be torn off.

Because the two grooves 21, 21' are near the axial ends 22, 22', a printing space is available between them which extends across nearly the entire width of the medium, this available space being indicated by the double arrow 27 in FIG. 2(*b*).

As designed in the embodiment of FIG. 1, the jacket 9 of the roller 10 is designed to repel adhesion; the same is also true for any other guide elements (not shown) for the medium located along the transport route between the supply roll 2 and the roller 10, insofar as these guide elements come in contact with the surface 4 with the self-adhesive coating.

In the description provided above, it has been assumed by way of example that, in the roll 2, the surface 4 of the medium with the self-adhesive coating faces the center of the roll. In this case, as shown in FIG. 1, the roll turns in the counterclockwise direction as the medium is unwinding. Alternatively, however, the roll 2 can be wound in such a way that the surface 3 to be printed faces the center of the roll. In this case, the roll 2 will be inserted into the device in such a way that it turns in the clockwise direction as it is being unwound. As a result of this type of winding, a pre-curvature is impressed into the medium even while it is on the roll 2, this pre-curvature being opposite the curvature of the roller 10. If suitable materials are chosen, this shape behavior can be sufficient in and of itself to separate the medium from the roller 10 without the need for any further impressing. In this case, the impressing device comprising the impressing cylinder 7 and the deflection roller 5 in FIG. 1 can be completely eliminated, and the medium can be transported directly from the roll 2 to the gap between the roller 10 and the print head 8.

List of Reference Numbers

1 base plate
2 supply roll
3 surface to be printed
4 surface with self-adhesive coating
5 deflection roller
6 bracket
7 impressing cylinder
8 print head
9 jacket
10 roller
11 bearing plate
12 gearing
13 electric motor
14 deflection roller
15 exit
16 tear-off bar
17 wrap angle
18 impressed curvature
19 guide element
20 peel-off angle
21, 21' grooves
22, 22' axial ends
23 roller core
24, 24' projections

25, 25' lateral edges

26, 26' ribs

27 double arrow

What is claimed is:

1. Method for printing on one surface (3) of a strip-shaped medium, the other surface (4) of which carries a self-adhesive coating, the medium being transported in its longitudinal direction through a printing mechanism including a print head (8), in which the surface (3) of the medium to be printed is conducted past the print head (8) and the surface (4) with the self-adhesive coating is conducted over a driven roller (10), wherein a shape behavior is impressed into the medium, as a result of which the medium separates itself from the roller (10).

2. Method according to claim 1, wherein a curvature is impressed into the medium in its longitudinal direction as it is being transported by the roller (10), the center of this curvature being opposite the surface (3) to be printed.

3. Method according to claim 2, wherein the surface (3) of the medium to be printed is transported over an impressing cylinder (7) around a wrap angle (17) suitable for the impressing, wherein the impressing cylinder has a radius suitable for impressing.

4. Method according to claim 1, wherein a rib (26, 26') extending in the longitudinal direction of the medium is impressed into the medium before it leaves the driven roller (10).

5. Method according to claim 4, wherein a rib (26, 26') is impressed along each of the two edges (25, 25') of the medium parallel to the longitudinal direction.

6. Method according to claim 4, wherein, before the medium passes through the printing mechanism, a curvature in the longitudinal direction is impressed into it, the center of this curvature being opposite the surface (4) with the self-adhesive coating.

7. Device for printing on one surface (3) of a strip-shaped medium, the other surface (4) of which carries a self-adhesive coating, with a printing mechanism which has a driven roller (10), over which the self-adhesive surface (4) is guided for transport in its longitudinal direction, and a print head (8), past which the surface (3) of the medium to be printed is transported, wherein a device through which the medium passes is provided to impress a shape behavior which separates the medium from the roller (10).

8. Device according to claim 7, wherein the device serving to impress the shape behavior is formed by an impressing mechanism (5, 7), located upstream from the roller (10) in the transport direction, to impress a curvature in the longitudinal direction of the medium, the center of this curvature being opposite the surface (3) to be printed.

9. Device according to claim 8, wherein the impressing mechanism has an impressing cylinder (7) with a radius suitable for impressing the curvature, around which cylinder the surface (3) of the medium to be printed wraps by a suitable angle (17) as it is conducted over it.

10. Device according to claim 9, wherein the impressing cylinder (7) is stationary.

11. Device according to claim 9, wherein the impressing cylinder (7) is mounted so that it can rotate around the cylinder axis.

12. Device according to claim 9, wherein a deflection roller (5) serving to adjust the wrap angle (17) is provided, over which the surface (4) of the medium with the self-adhesive coating is guided.

13. Device according to claim 12, wherein the deflection roller (5) is located a certain distance away from the impressing cylinder (7).

14. Device according to claim 12, wherein the deflection roller can be shifted between an operating position, in which it cooperates with the impressing cylinder (7) to form a roll clamping gap for the passage of the medium, and a release position, in which it is a certain distance away from the impressing cylinder (7).

15. Device according to claim 14, wherein two deflection rollers are provided, each of which can be shifted between an operating position and a release position, one of these rollers defining the beginning of the wrap angle (17), the other defining the other end of the wrap angle (17).

16. Device according to claim 7, wherein the device serving to impress the shape behavior is formed by the roller (10) and an opposing element (24, 24') cooperating with the roller to impress a rib (26, 26') extending in the longitudinal direction into the medium being transported between the roller (10) and the opposing element (24, 24').

17. Device according to claim 16, wherein the opposing element (24, 24') is located on the print head (8).

18. Device according to claim 16, wherein the roller (10) has a circumferential groove (21, 21') in the area of its jacket (9) which guides the medium, and in that the opposing element has a projection (24, 24'), which projects into the groove (21, 21').

19. Device according to claim 18, wherein a groove (21, 21') and a projection (24, 24') are located near each of the two edges (25, 25') of the medium parallel to the longitudinal direction.

20. Device according to claim 7, wherein the medium to be supplied is wound into a roll (2), in which the surface (4) with the self-adhesive coating faces the center of the roll.

21. Device according to claim 7, wherein the medium to be supplied is wound into a roll (2), in which the surface (3) to be printed faces the center of the roll.

22. Device according to claim 7, wherein surface areas of the device which come in contact with the surface (4) with the self-adhesive coating have adhesive-repellent coatings.

* * * * *